US008251024B2

(12) United States Patent
Hutchins

(10) Patent No.: US 8,251,024 B2
(45) Date of Patent: Aug. 28, 2012

(54) COOLING SYSTEM EXPANSION TANK

(75) Inventor: William Richard Hutchins, Kenilworth (GB)

(73) Assignees: Ford Global Technologies, LLC, Dearborn, MI (US); Jaguar Cars Limited, Coventry (GB)

( * ) Notice: Subject to any disclaimer, the term of this patent is extended or adjusted under 35 U.S.C. 154(b) by 924 days.

(21) Appl. No.: 12/336,339

(22) Filed: Dec. 16, 2008

(65) Prior Publication Data

US 2009/0159019 A1 Jun. 25, 2009

(30) Foreign Application Priority Data

Dec. 20, 2007 (GB) ..... 0724764

(51) Int. Cl.
*F01P 3/22* (2006.01)

(52) U.S. Cl. ..... 123/41.54; 220/564; 220/746

(58) Field of Classification Search ..... 123/41.54; 165/104.32; 220/564, 746
See application file for complete search history.

(56) References Cited

U.S. PATENT DOCUMENTS 2,200,620 A * 5/1940 Findley ..... 123/41.21
3,771,290 A * 11/1973 Stethem ..... 210/304
4,273,563 A * 6/1981 Fadda et al. ..... 123/41.54

* cited by examiner

*Primary Examiner* — Noah Kamen
(74) *Attorney, Agent, or Firm* — James Dottavio; Alleman Hall McCoy Russell & Tuttle LLP

(57) ABSTRACT

An expansion tank for an engine cooling system comprises a housing forming a main chamber and a swirl chamber, the swirl chamber being defined by a cylindrical wall. An inlet connection discharges through an inlet orifice towards a collector duct having an entrance. From the inlet orifice the coolant is directed as a stream or jet along the adjacent surface of the cylindrical wall towards the entrance of the collector duct, guided by circumferential ribs. The kinetic energy of the stream is converted into pressure energy so that the pressure delivered from the outlet connection is slightly above the pressure at the top of the swirl chamber, above the level of liquid. This swirl chamber pressure is set by the relief pressure allowed by a filler cap, the gain in pressure helping to avoid cavitation in a coolant circulation pump.

16 Claims, 3 Drawing Sheets

COOLING SYSTEM EXPANSION TANK

CROSS REFERENCE TO PRIORITY APPLICATION

This present application claims priority to United Kingdom Application Number 0724764, filed Dec. 20, 2007, entitled "Cooling System Expansion Tank", naming William Richard Hutchins as the inventor, the entire contents of which are incorporated herein by reference.

FIELD

This invention relates to expansion tanks for the cooling systems of liquid cooled internal combustion engines.

BACKGROUND/SUMMARY

A typical cooling system expansion tank is a closed vessel which, when the engine is at rest, is only partially filled with liquid coolant, the remainder of the space above the liquid being available for the volumetric expansion of the coolant due to heat. Coolant discharged from the engine flows into the tank and returns from the tank to join the flow of coolant returned to the engine. Such an expansion tank also serves as a means of enabling gasses dissolved or trapped in the coolant to rise to the liquid surface and escape. The expansion tank also usually incorporates a filler cap with a two-way valve which sets the maximum pressure in the cooling system and allows the intake of air if a negative pressure develops. Such a filler cap is usually known as a pressure cap.

However, the inventors herein have recognized several issues with such an approach. As one example, in the design of such expansion tanks the pressure at the outlet as dictated by the pressure cap, and may, in extreme engine running conditions, be insufficient to prevent cavitation at the circulating pump. An object of the invention is to provide a cooling system expansion tank which overcomes or alleviates this problem.

Thus, in one example, the above issues may be addressed by providing an expansion tank for the cooling system of a liquid-cooled internal combustion engine, the tank comprising a housing which includes a cylindrical wall defining a swirl chamber, an inlet connection on the housing for connection to a supply of coolant discharged from the engine, the inlet connection being arranged to duct coolant to an inlet orifice opening into the swirl chamber, an outlet connection on the housing for the return of coolant to the engine, the outlet connection being arranged to duct coolant from a collector duct having an entrance opening into the swirl chamber, the inlet orifice and the collector duct being arranged such that when the tank is in use, coolant may be discharged into the swirl chamber in a direction tangential to the cylindrical wall, and coolant may be directed along the cylindrical wall into the collector duct. In some examples, the cylindrical wall may be arranged with its axis substantially vertical.

Conveniently, the housing defines a main chamber and the swirl chamber is positioned within the main chamber. In such an arrangement the swirl chamber may have an outlet aperture opening into the main chamber and positioned above the inlet orifice and the collector duct. The swirl chamber may also have an inlet aperture opening from the main chamber and positioned below the inlet orifice and the collector duct, preferably substantially on the axis of the swirl chamber.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIGS. 2-3 are drawn approximately to scale.

DETAILED DESCRIPTION

Figure 1:
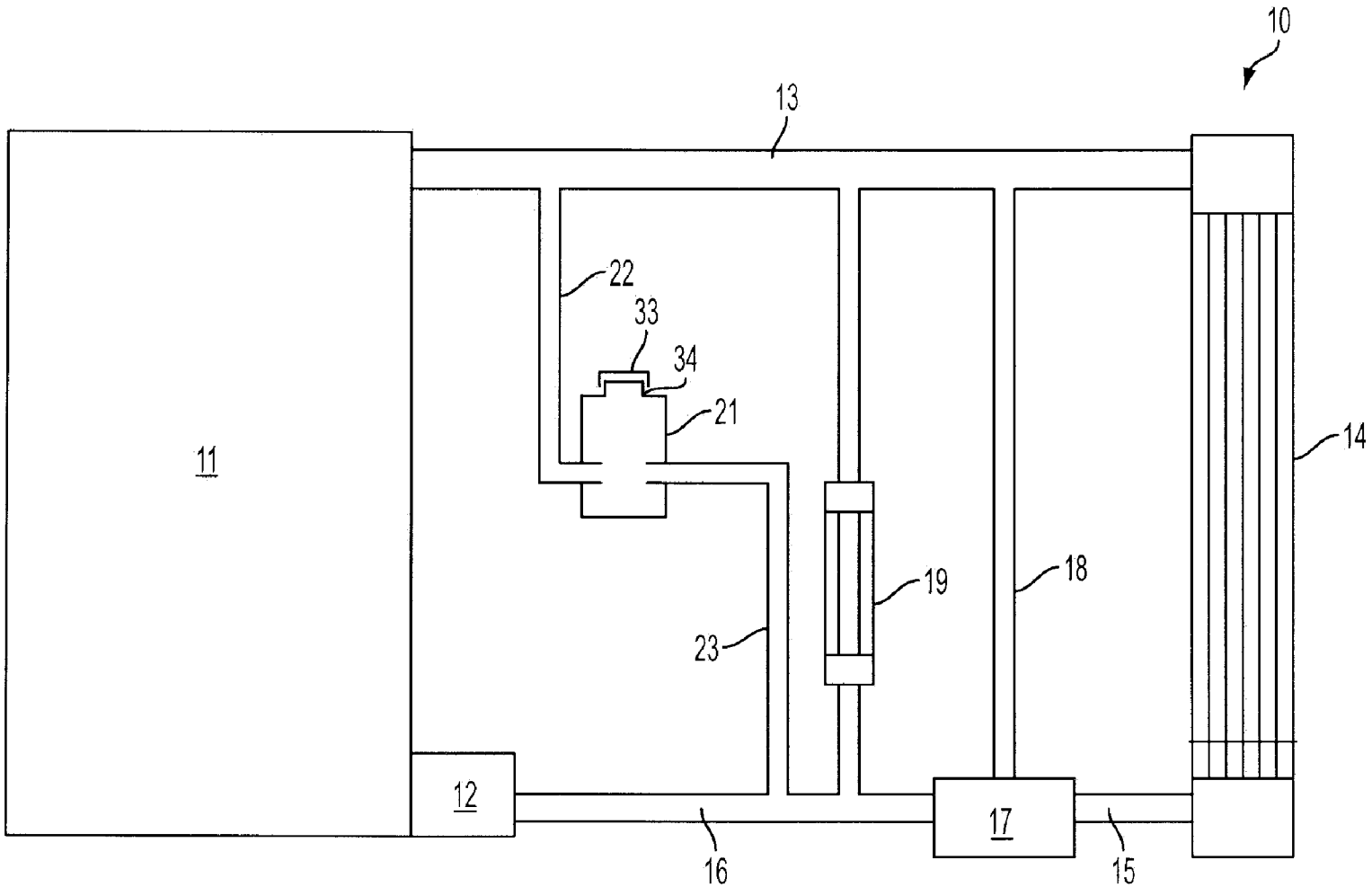
FIG. 1 is a diagrammatic representation of the cooling system of a liquid cooled internal combustion engine incorporating an expansion tank according to various embodiments.

FIG. 1 is a diagrammatic representation of the cooling system of a liquid cooled internal combustion engine incorporating an expansion tank according to various embodiments. An internal combustion engine 11 has an engine driven pump 12 which can deliver liquid coolant (e.g., a water/antifreeze mix) through the engine to an engine delivery line 13 and a radiator 14. Flow from the radiator 14 to the pump 12 is through a radiator return line 15 and a pump return line 16. A thermostat and bypass control valve 17 operates to control flow in the radiator return line 15 and in a bypass line 18 such that until the coolant reaches higher temperatures most of the flow of coolant from the engine 11 is through the bypass line 18 and there is no flow through the radiator 14. At higher coolant temperatures, most of the flow is through the radiator 14 and not through the bypass line 18. An expansion tank 21 has a tank feed line 22 connected to the engine delivery line 13 and a tank return line 23 connected to the pump return line 16. A heater matrix 19 for the heating a vehicle passenger compartment is also connected between the engine delivery line 13 and the pump return line.

Figure 2:
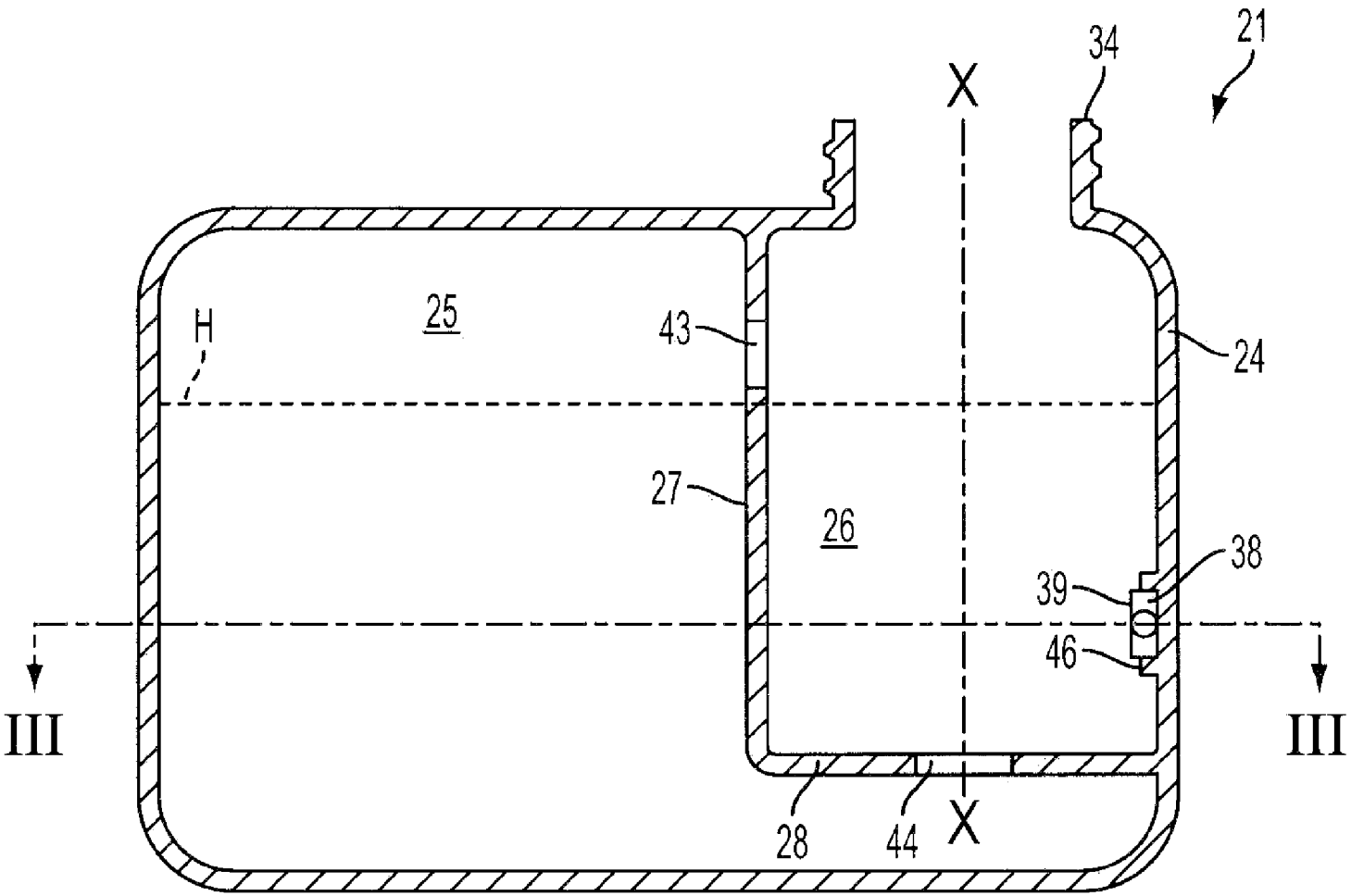
FIG. 2 is a vertical cross-section through the expansion tank shown in FIG. 1.

FIG. 2 is a vertical cross-section through the expansion tank shown in FIG. 1. The expansion tank 21 comprises a housing 24 forming a main chamber 25 and a swirl chamber 26, the swirl chamber being defined by a cylindrical wall 27, part of which separates the swirl chamber from the main chamber and the remainder being part of an outside wall 28. A filler neck 34 is positioned on the axis X-X of the swirl chamber for closure by a filler cap 33 (FIG. 1) which incorporates the normal pressure control valve and anti-vacuum valve. An outlet aperture 43 is arranged in the cylindrical wall 27 above a dashed line H indicating the maximum level of liquid coolant in the expansion tank 21 while an inlet aperture 44 is arranged in the cylindrical wall 27 in a bottom wall 28 of the swirl chamber 26 on the axis X-X.

In some cases at least portions of the swirl chamber 26 may be made integrally with at least portions of the main chamber 25. In other cases substantially all of the swirl chamber 26 may be made integrally with substantially all of the main chamber 25. In still other cases the swirl chamber 26, and the main chamber 25 may be separate elements.

Figure 3:
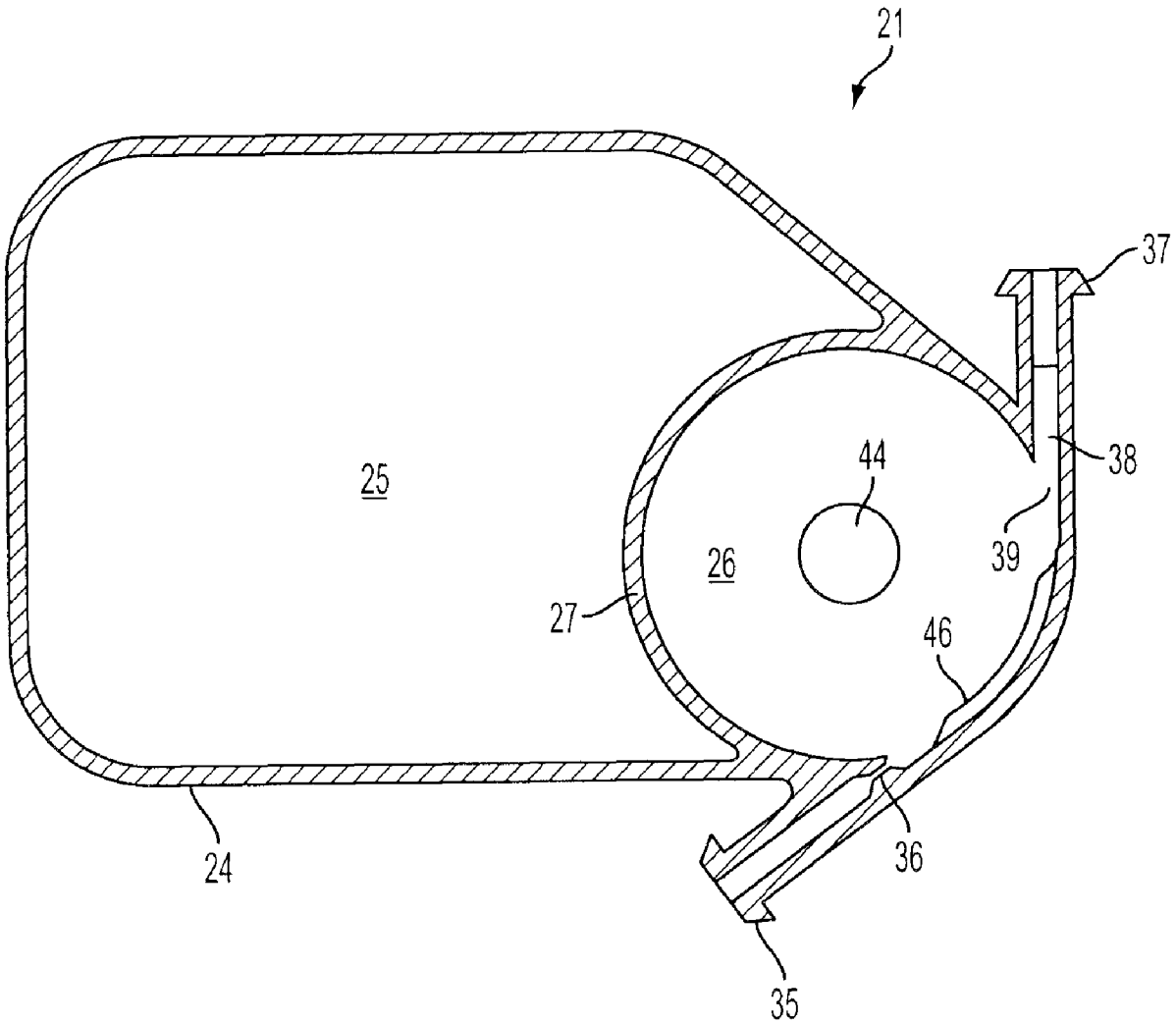
FIG. 3 is a section on the line III-III in FIG. 2.

FIG. 3 is a section on the line III-III in FIG. 2. The housing 24 has an inlet connection 35 for connection to the tank feed line 22 and this discharges through an inlet orifice 36 located in the swirl chamber 26 well below the outlet aperture 43, the inlet orifice 36 being aligned tangentially of the cylindrical wall 27. The housing 24 also has an outlet connection 37 for connection to the tank return line 23 and this connects to a collector duct 38 spaced circumferentially from the inlet orifice 36, the collector duct 38 having an entrance which opens into the swirl chamber 26. Between the inlet orifice 36 and the collector duct 38 there are two circumferential ribs 46, vertically positioned one above and one below the collector duct entrance 39.

In use, with a cold engine 11 and cooling system, the level of liquid coolant in the expansion tank 21 will be below the line H but above the inlet orifice 36 and the collector duct 38, i.e. above the section line III-III in FIG. 2. Coolant is pumped by the pump 12 out of the engine 11 into the delivery line 13 through the tank feed line 22 and into the expansion tank 21 through the inlet orifice 36. From the inlet orifice 36 the coolant is directed as a stream or jet along the adjacent surface of the cylindrical wall 27 towards the entrance 39 of the collector duct 38. The circumferential ribs 46 help to guide this flow. The coolant swirls or rotates about the vertical axis X-X (anticlockwise as seen in FIG. 3) which causes gases and vapours to separate out from the liquid coolant and move towards the centre of rotation. By positioning the collector duct 38 in the stream from the inlet orifice 36 the kinetic energy of the stream is converted into pressure energy so that the pressure delivered from the outlet connection 37 to the tank return line is slightly above the pressure at the top of the swirl chamber 26, above the level of liquid. This swirl chamber pressure is set by the relief pressure allowed by the filler cap 33. This gain in pressure is at a maximum at higher engine speeds when cavitation of the pump 12 is most likely and thus helps to avoid such cavitation.

The relative circumferential locations of the inlet orifice 36 and the entrance 39 to the collector duct 38 along the surface of the cylindrical wall 27 may affect the amount of kinetic energy transferred from the inlet flow to the outlet flow. In some cases the relative circumferential locations may be selected such that a shortest circumferential arc subtended by a portion of the cylindrical wall 27 within the swirl chamber 26 from the inlet orifice of the inlet connection 35 to the entrance 39 of the collector duct 38 may be between 0 and 90 deg. In this way the amount of kinetic energy transferred may be substantial while still achieving a sufficient swirl within the swirl chamber 26. In some cases the shortest circumferential arc may be approximately 45 deg.

The coolant may be at a first level being below the outlet aperture 43 when the coolant is below a predetermined temperature and/or a flow of the coolant through the expansion tank is below a predetermined flow rate. The coolant may be at a second level being high enough to spill from the swirl chamber 26 through the outlet aperture 43 to the main housing 25 when the temperature of the coolant is above the predetermined temperature and/or the flow of the coolant is above the predetermined flow rate.

At lower engine speeds and coolant flows, the coolant circles within the swirl chamber relatively gently but at the higher engine speeds and coolant flows, the circulation in the swirl chamber 26 is enough to cause the coolant to flow out into the main chamber through the outlet aperture 43 to be replenished by coolant flowing in through the inlet aperture 44. Because the main flow, particularly at lower engine speeds, is within the swirl chamber, the volume of liquid coolant in circulation is reduced so that warm-up from cold is enhanced.

In a modification, not shown, the housing 24 has the main chamber 25 omitted and the swirl chamber 26 is formed by the outside wall, the outlet aperture 43 and the inlet aperture 44 also being omitted.

Referring now to FIGS. 1, 2 and 3, various embodiments may provide a cooling system 10 for an internal combustion engine 11. The system 10 may include an expansion tank 21 coupled with the engine 11. The expansion tank 21 may be configured to receive a flow of coolant directly, or indirectly, from the engine 11. The expansion tank 21 may have a main chamber 25 and a substantially cylindrical swirl chamber 26. The flow of coolant from the engine 11 may be configured to enter the swirl chamber 26 substantially tangential to an inside surface of the swirl chamber 26, and configured to flow out of the swirl chamber 26 substantially tangential to the inside surface back directly, or indirectly, to the engine 11. The swirl chamber 26 may be configured to hold a first volume of coolant and the main chamber 25 may be configured to hold a second volume of coolant. The swirl chamber 26 may have an outlet aperture 43 that may be configured to allow at least portions of the first volume of coolant to spill, or to flow into the second volume when a temperature of the coolant is greater than a predetermined temperature, and/or when a rate of flow of the coolant is greater than a predetermined rate of flow. The swirl chamber 26 may have an inlet aperture 44 configured to allow coolant from the main chamber 25 to flow into the swirl chamber 26. In some cases, the predetermined temperature may be dependent on the rate of flow, and/or the predetermined rate of flow, may be dependent on the temperature.

The following claims particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements. Other combinations and subcombinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An expansion tank for the cooling system of a liquid-cooled internal combustion engine, the tank comprising a housing which includes a cylindrical wall defining a swirl chamber, an inlet connection on the housing for connection to a supply of coolant discharged from the engine, the inlet connection being arranged to duct coolant to an inlet orifice opening into the swirl chamber, an outlet connection on the housing for the return of coolant to the engine, the outlet connection being arranged to duct coolant from a collector duct having an entrance opening into the swirl chamber, the inlet orifice and the collector duct being arranged such that in use of the tank coolant is discharged into the swirl chamber in a direction tangential to the cylindrical wall and is directed along the cylindrical wall into the collector duct, wherein the housing defines a main chamber and the swirl chamber is positioned within the main chamber, the swirl chamber having an outlet aperture opening into the main chamber and positioned above the inlet orifice and the collector duct, and the swirl chamber further having an inlet aperture opening from the main chamber and positioned below the inlet orifice and the collector duct.

2. The tank according to claim 1, wherein the cylindrical wall is arranged with its axis substantially vertical.

3. The tank according to claim 1, wherein the inlet aperture is positioned substantially on an axis of the swirl chamber.

4. An expansion tank for a cooling system of a liquid-cooled internal combustion engine, the tank comprising:

a cylindrical wall defining a swirl chamber, an inlet connection opening into the swirl chamber to supply coolant to the swirl chamber from the engine, a collector duct open to the swirl chamber to return coolant to the engine, the inlet connection and the collector duct being arranged such that coolant is discharged from the inlet connection into the swirl chamber in a direction tangential to the cylindrical wall, and is directed along the cylindrical wall into the collector duct, the tank further comprising two circumferential ribs vertically positioned one above and one below an entrance of the collector duct.

5. The expansion tank of claim 4, further comprising a main chamber coupled with a cylinder, an outlet aperture in the swirl chamber to allow coolant to flow from the swirl chamber to the main chamber, and an inlet aperture configured to allow coolant to flow from the main chamber to the swirl chamber.

6. The expansion tank of claim 4, wherein at least portions of the swirl chamber are made integrally with at least portions of the main chamber.

7. The expansion tank of claim 5, wherein the coolant is at a first level being below the outlet aperture when the coolant is below a predetermined temperature and/or a flow of the coolant through the expansion tank is below a predetermined flow rate, and the coolant is at a second level being high enough to spill from the swirl chamber through the outlet aperture to a main housing when a temperature of the coolant is above the predetermined temperature and/or the flow of the coolant is above the predetermined flow rate.

8. The expansion tank of claim 7, wherein the swirl chamber has an axis being arranged substantially vertically.

9. The expansion tank of claim 8, wherein the inlet aperture is positioned substantially on the axis of the swirl chamber.

10. The expansion tank of claim 4, wherein a shortest circumferential arc subtended by a portion of a cylindrical wall within the swirl chamber from an inlet orifice of the inlet connection to the entrance of the collector duct is between 0 and 90 degrees.

11. The expansion tank of claim 10, wherein the shortest circumferential arc is approximately 45 degrees.

12. A cooling system for an internal combustion engine comprising:

an expansion tank coupled with the engine and configured to receive a flow of coolant from the engine, the expansion tank having a main chamber and a substantially cylindrical swirl chamber, the flow of coolant from the engine configured to enter the swirl chamber substantially tangential to an inside surface of the swirl chamber and configured to flow out of the swirl chamber substantially tangential to the inside surface back to the engine; and the swirl chamber configured to hold a first volume of coolant and the main chamber configured to hold a second volume of coolant, the swirl chamber having an outlet aperture configured to allow at least portions of the first volume of coolant to spill, or to flow into the second volume when a temperature of the coolant is greater than a predetermined temperature, and/or when a rate of flow of the coolant is greater than a predetermined rate of flow, the swirl chamber having an inlet aperture configured to allow coolant from the main chamber to flow into the swirl chamber.

13. The cooling system of claim 12, wherein at least a portion of a cylindrical wall defining the swirl chamber separates the swirl chamber from the main chamber, and the outlet aperture passes through the portion of the cylindrical wall.

14. The cooling system of claim 12, wherein the inlet aperture is located at a bottom of the swirl chamber.

15. The cooling system of claim 12, wherein the swirl chamber has a substantially vertical axis, the axis passing through the inlet aperture.

16. The cooling system of claim 12, wherein the swirl chamber has an inlet orifice allowing coolant flow into the swirl chamber and a collector duct entrance allowing coolant flow out of the swirl chamber, and further comprising two spaced apart circumferential ribs extending from the inlet orifice to the collector duct entrance being vertically positioned one above and one below the collector duct entrance.

* * * * *